US008376342B2

(12) United States Patent
Lee

(10) Patent No.: US 8,376,342 B2
(45) Date of Patent: Feb. 19, 2013

(54) CLAMPING DEVICE

(75) Inventor: Hsin-Ho Lee, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 316 days.

(21) Appl. No.: 12/859,189

(22) Filed: Aug. 18, 2010

(65) Prior Publication Data

US 2011/0266735 A1 Nov. 3, 2011

(30) Foreign Application Priority Data

Apr. 30, 2010 (TW) ..... 99113764 A

(51) Int. Cl.
*B25B 1/06* (2006.01)

(52) U.S. Cl. ..... 269/254 CS; 269/26; 269/66; 269/87.2; 269/229; 269/231; 24/489; 24/530; 24/567

(58) Field of Classification Search ..... 269/3, 6, 269/26, 34, 66, 87.2, 95, 229, 231, 254 CS, 269/268, 279, 283, 309, 310; 24/489, 530, 24/544, 567
See application file for complete search history.

(56) References Cited

U.S. PATENT DOCUMENTS 3,237,260 A * 3/1966 Kallman et al. ..... 24/567
4,486,010 A * 12/1984 Haas, Jr. ..... 269/3
4,695,047 A * 9/1987 Ehrhardt et al. ..... 269/309
5,464,231 A * 11/1995 Clay ..... 279/123
5,669,807 A * 9/1997 Moreau et al. ..... 451/460
5,820,116 A * 10/1998 Haese ..... 269/21
6,532,861 B2 * 3/2003 Etter ..... 92/86
8,042,438 B2 * 10/2011 Huang ..... 82/163
8,087,651 B2 * 1/2012 Dahlquist ..... 269/309
2004/0051225 A1 * 3/2004 Etter ..... 269/309
2006/0220292 A1 * 10/2006 Dahlquist ..... 269/309
2007/0122520 A1 * 5/2007 Chien ..... 425/589
2010/0019428 A1 * 1/2010 Sandmeier ..... 269/168

* cited by examiner

*Primary Examiner* — Joshua J Michener
*Assistant Examiner* — Matthew Gitlin
(74) *Attorney, Agent, or Firm* — Altis Law Group, Inc.

(57) ABSTRACT

A clamping device includes two springs, a first barrel, and a second barrel. Each of the two springs includes a first end and a second end. The first barrel is attached to the first ends of the springs, and includes a number of first clamping portions, a number of first slots, and a first receiving space. The first clamping portions and the first slots are alternately arranged around the first receiving space. The second barrel is attached to the second ends of the springs and received in the first receiving space. The second barrel includes a number of second clamping portions, a number of second slots, and a second receiving space. The second clamping portions and the second slots are alternately arranged around the second receiving space. The second barrel is rotatable relative to the first barrel in the first receiving space between a first position and a second position.

20 Claims, 11 Drawing Sheets

CLAMPING DEVICE

BACKGROUND

1. Technical Field

The disclosure substantially relates to clamping devices, and more particularly to a clamping device for clamping a lens preform.

2. Description of Related Art

Currently, plastic lenses are widely used in consumer electronic products, for example, digital cameras, as they are cheap and simple to manufacture.

In general, in manufacturing the plastic lenses, a lens preform including the plastic lenses is formed by applying a plastic injection molding process, and then the plastic lenses can be cut from the lens preform. Referring to FIG. 10, a typical lens preform 40 is shown. The lens preform 40 may include four plastic lenses 42, a sprue 44, and four runners 46. Each of the runners 46 is connected to the sprue 44. The four plastic lenses 42 are connected to the four respective runners 46.

In general, before the plastic lenses 42 can be cut away from the runners 46, a clamping device 50 as shown in FIG. 11 is provided to clamp the lens preform 40. The clamping device 50 has a first groove 52 and a second groove 54 defined at a top surface 51 thereof. The first groove 52 intersects and communicates with the second groove 54. In use, the runners 46 of the lens preform 40 are received in the first groove 52 and the second groove 54. A knife 60 can be provided to cut the plastic lenses 42 away from the runners 46.

However, it is very difficult to for the clamping device 50 to clamp the lens preform 10 firmly as the lens preform 10 may vibrate in the first and the second grooves 52 and 54. In that case, the plastic lenses 42 cannot be properly cut from the lens preform 10.

Therefore, what is needed is a clamping device that can overcome the described limitations.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the present clamping device. Moreover, in the drawings, all the views are schematic, and like reference numerals designate corresponding parts throughout the several views.

DETAILED DESCRIPTION

Embodiments of the clamping device will now be described in detail below and with reference to the drawings.

Figure 1:
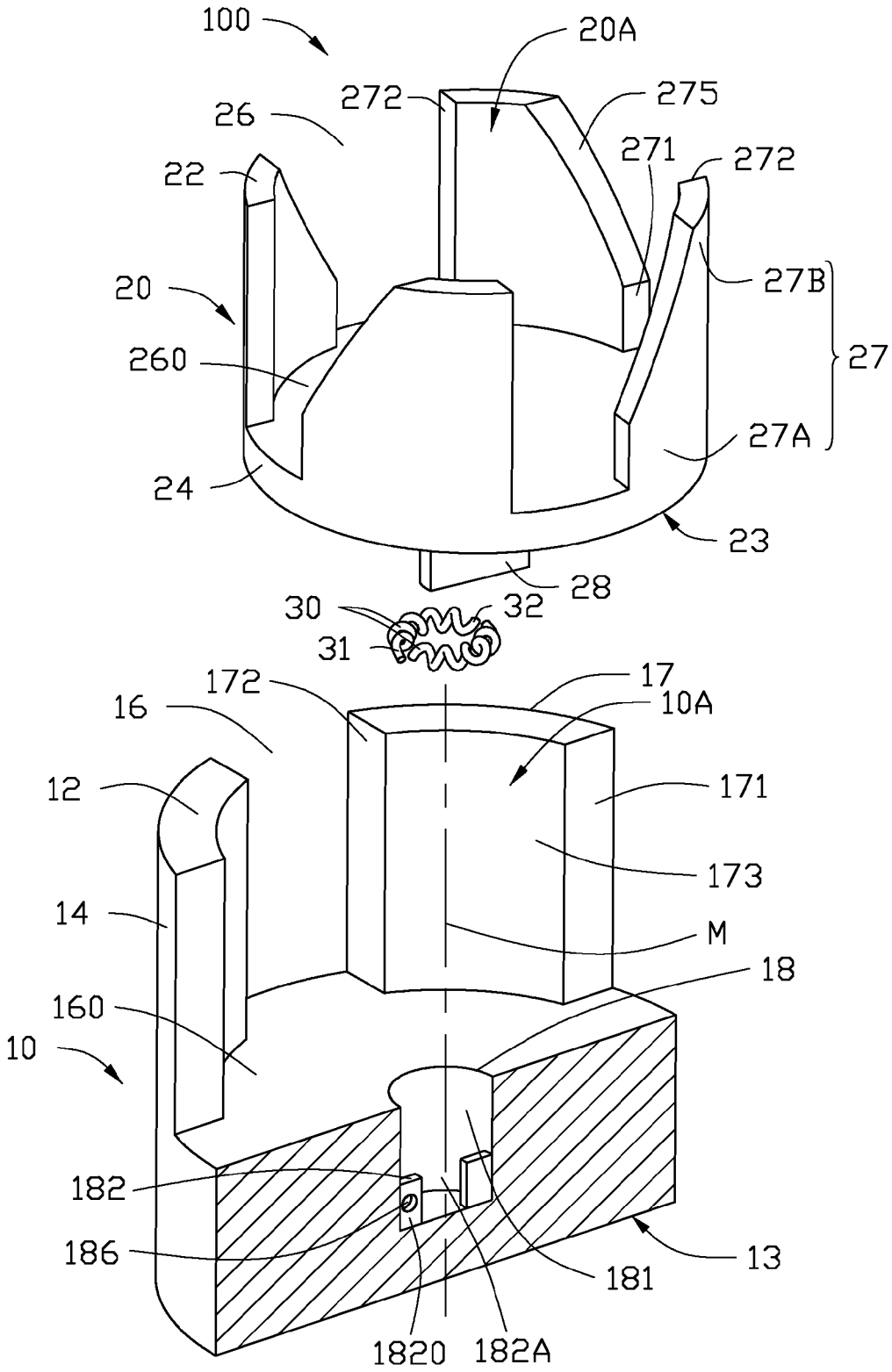
FIG. 1 is a disassembled view of a clamping device in accordance with a first embodiment, the clamping device including a first barrel, a second barrel, and two springs.
Figure 2:
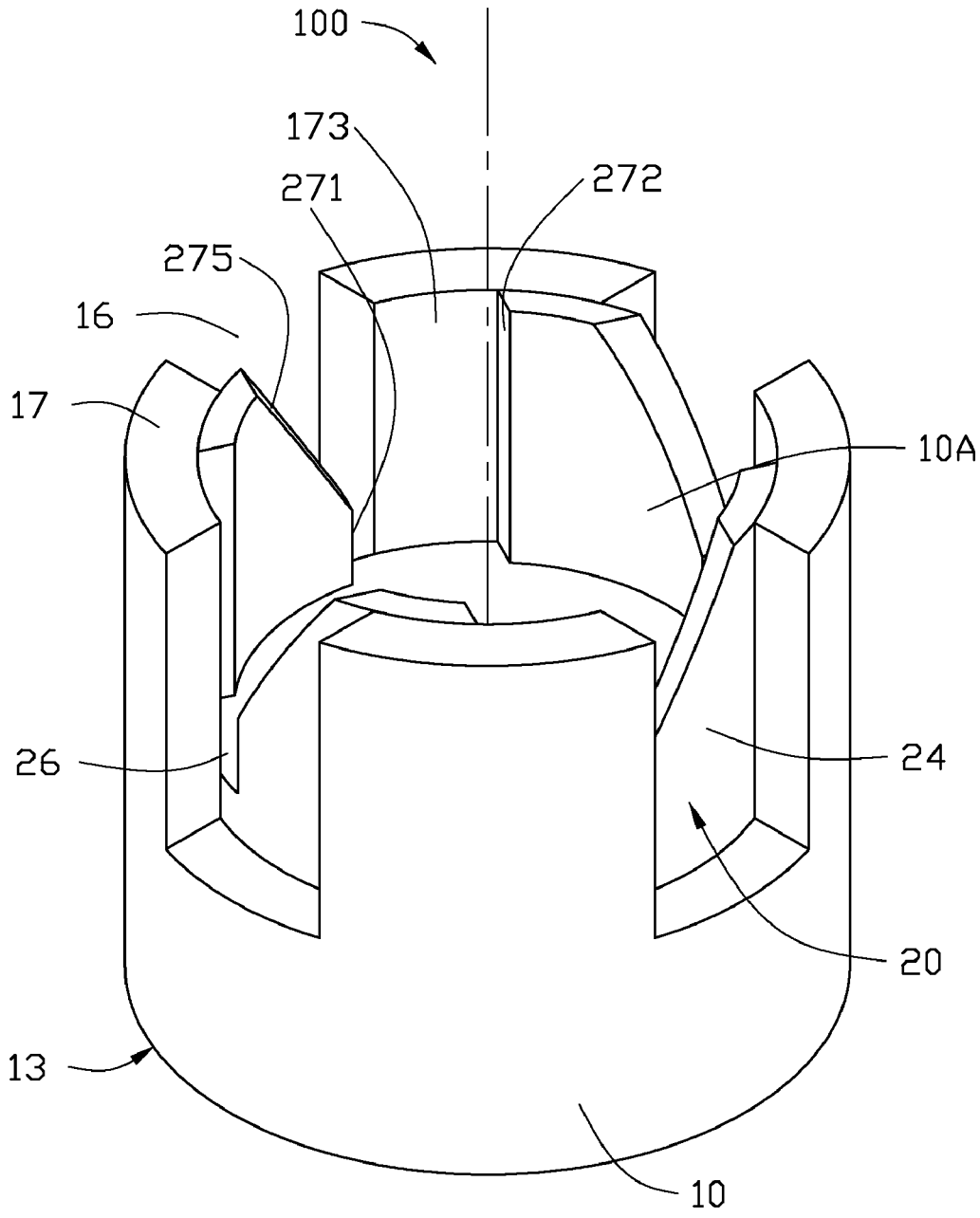
FIG. 2 is an assembled view of the clamping device of FIG. 1.

Referring to FIG. 1 and FIG. 2, a clamping device 100 according to a first embodiment is shown. The clamping device 100 includes a first barrel 10, a second barrel 20, and two springs 30.

As shown in FIG. 1, the first barrel 10 is substantially cylindrical. The first barrel 10 includes a first top surface 12, a first bottom surface 13, and a first peripheral surface 14. The first top surface 12 and the first bottom surface 13 are located at two opposite sides of the first barrel 10. The first peripheral surface 14 is located between, and adjoins the first top surface 12 and the first bottom surface 13. The first barrel 10 has a first receiving space 10A defined in the first top surface 12, and four first slots 16 defined in the first peripheral surface 14. The first slots 16 each communicates with the first receiving space 10A, and is exposed at the first top surface 12. In this embodiment, the first top surface 12 and the first bottom surface 13 are generally parallel to each other. The first receiving space 10A is generally cylindrical with a central axis M perpendicular to the first top surface 12 and the first bottom surface 13. The first barrel 10 includes a bottom surface 160 located in the first receiving space 10A. The bottom surface 160 is substantially parallel to the first top surface 12 and the first bottom surface 13.

In this embodiment, the first barrel 10 includes four first clamping portions 17. The four first clamping portions 17 are evenly spaced from one another around the first receiving space 10A. Each first clamping portion 17 is located between each two neighboring first slots 16. That is, the first clamping portion 17 and the first slots 16 are alternately arranged around the first receiving space 10A. The first clamping portion 17 extends from the first top surface 12 to the bottom surface 160, and includes a first side surface 171, a second side surface 172, and an internal peripheral surface 173. The first side surface 171 and the second side surface 172 are located at two opposite sides of the first clamping portion 17. Each of the first side surface 171 and the second side surface 172 adjoins the first top surface 12 and the bottom surface 160, and is exposed at the two neighboring first slots 16. In this embodiment, the first side surface 171 and the second side surface 172 each are perpendicular to the bottom surface 160. The internal peripheral surface 173 is located between, and adjoins the first side surface 171 and the second side surface 172. In addition, the internal peripheral surface 173 is exposed at the first receiving space 10A.

The first barrel 10 has a hole 18 defined in a central portion of the bottom surface 160. In this embodiment, the hole 18 is generally cylindrical, and extends along the central axis M of the first barrel 10 but not extend through the first bottom surface 13. The first barrel 10 has an inner sidewall 181 in the hole 18. The inner sidewall 181 adjoins the bottom surface 160. In alternative embodiments, the hole 18 may extend all the way through the first bottom surface 13.

The first barrel 10 includes two blocks 182 extending from the inner sidewall 181. In this embodiment, the two blocks 182 are spaced from each other, and are symmetrically opposite to each other across the central axis M. A gap 182A is defined between the two blocks 182. The two blocks 182 each include two surfaces 1820 at two opposite sides thereof. The two surfaces 1820 of the block 182 face the inner sidewall 181. In this embodiment, the two blocks 182 each has a blind hole 186 defined in a surface 1820 thereof. The two blind holes 186 are defined in two surfaces 1820 of the two blocks 182 facing away from each other.

The second barrel 20 includes a second top surface 22, a second bottom surface 23, and a second peripheral surface 24. The second top surface 22 and the second bottom surface 23 are located at two opposite sides of the second barrel 20. The second peripheral surface 24 is located between, and adjoins the second top surface 22 and the second bottom surface 23. The second barrel 20 has a second receiving space 20A defined in the second top surface 22, and four second slots 26 defined in the second peripheral surface 24. The second slots 26 each communicates with the second receiving space 20A, and is exposed at the second top surface 22. In this embodiment, the second barrel 20 includes a bottom surface 260 located in the second receiving space 20A. The bottom surface 260 is substantially parallel to the second top surface 22 and the second bottom surface 23.

In this embodiment, the second barrel 20 includes four second clamping portions 27. Each second clamping portion 27 is defined between each two neighboring second slots 26, and includes a first end 27A and a second end 27B. The first end 27A extends from the bottom surface 260. The second end 27B is distal from the bottom surface 260. The second clamping portion 27 includes a third side surface 271, a fourth side surface 272, and a fifth side surface 275. The third side surface 271, the fourth side surface 272, and the fifth side surface 275 are exposed to the second slots 26. The third side surface 271 and the fourth side surface 272 are located at two opposite sides of the second clamping portion 27, and are substantially perpendicular to the bottom surface 260. The third side surface 271 of each second clamping portion 27 faces the fourth side surface 272 of a neighboring second clamping portion 27. In this embodiment, the fourth side surface 272 adjoins the second top surface 22 and the second bottom surface 260. The third side surface 271 adjoins the second bottom surface 260. The fifth side surface 275 adjoins the second top surface 22 and the third side surface 271. In this embodiment, the fifth side surface 275 is located at the second end 27B, and inclined relative to the second bottom surface 260. A width of the second end 27B measured between the two neighboring second slots 26 increases in a direction toward the bottom surface 260.

The second barrel 20 includes an engaging portion 28 extending from a central portion of the second bottom surface 23 thereof. In this embodiment, the engaging portion 28 is cuboid-shaped. A length of the engaging portion 28 is equal to or less than a diameter of the hole 18.

In this embodiment, each spring 30 is a coil spring, and includes a first end 31 and a second end 32 at two opposite sides thereof.

Figure 3:
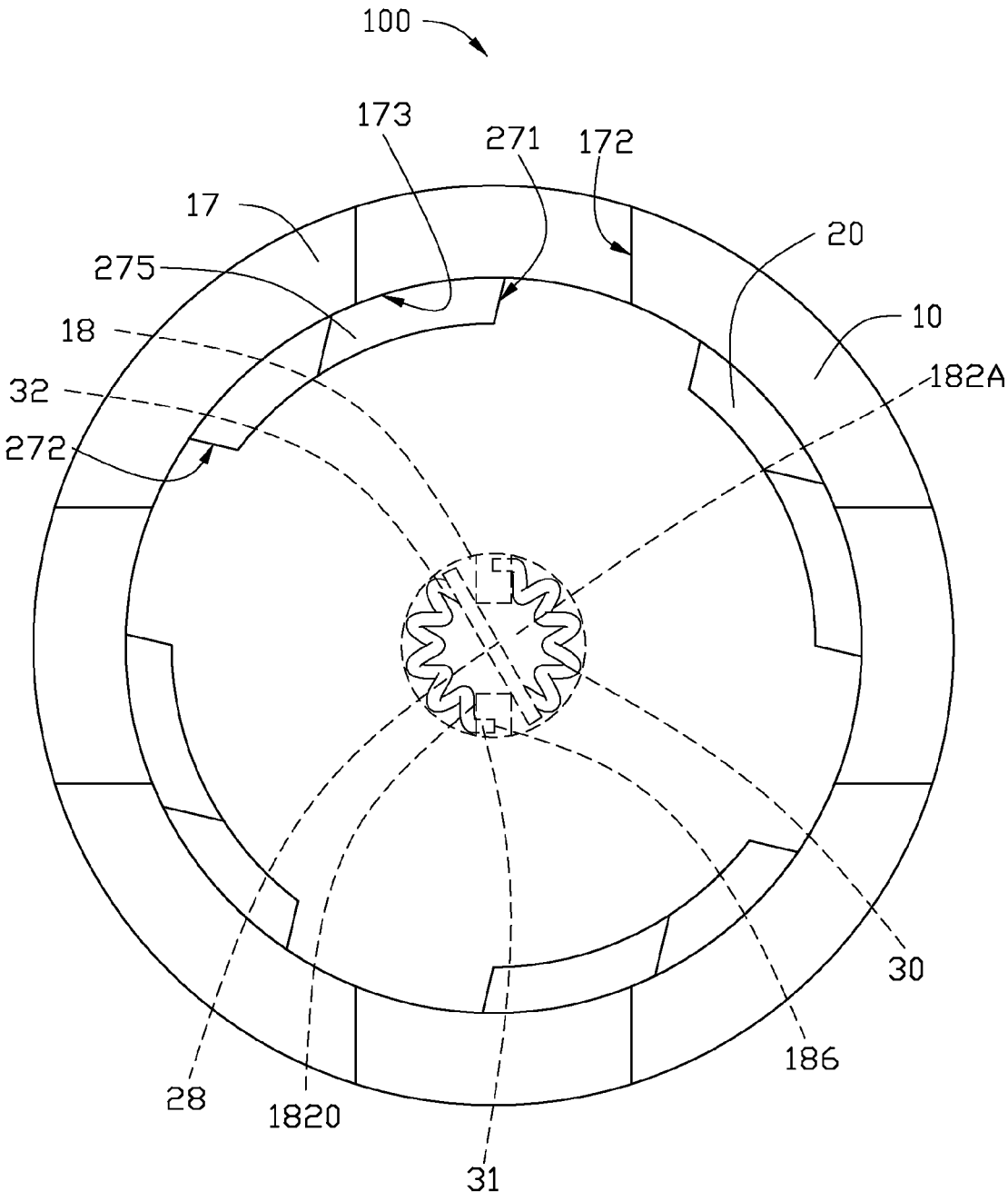
FIG. 3 is a top plan view of the clamping device of FIG. 2, showing the first barrel and the second barrel cooperatively receiving the springs.

Referring also to FIG. 2 and FIG. 3, a diameter of the second barrel 20 measured at the second peripheral surface 24 is substantially the same as a diameter of the first barrel 10 measured at first receiving space 10A. In assembly, the two springs 30 are received in the hole 18. The second barrel 20 is received in the first receiving space 10A of the first barrel 10, and the engaging portion 28 of the second barrel 20 is received in the hole 18. The engaging portion 28 extends through the gap 182A and engages with an inner sidewall 2181. The two springs 30 are located at two opposite sides of the engaging portion 28. The two first ends 31 of the two springs 30 are received in the two respective blind holes 186. The two springs 30 each extend along the circumference and abut against the engaging portion 28 at two opposite sides thereof.

Figure 4:
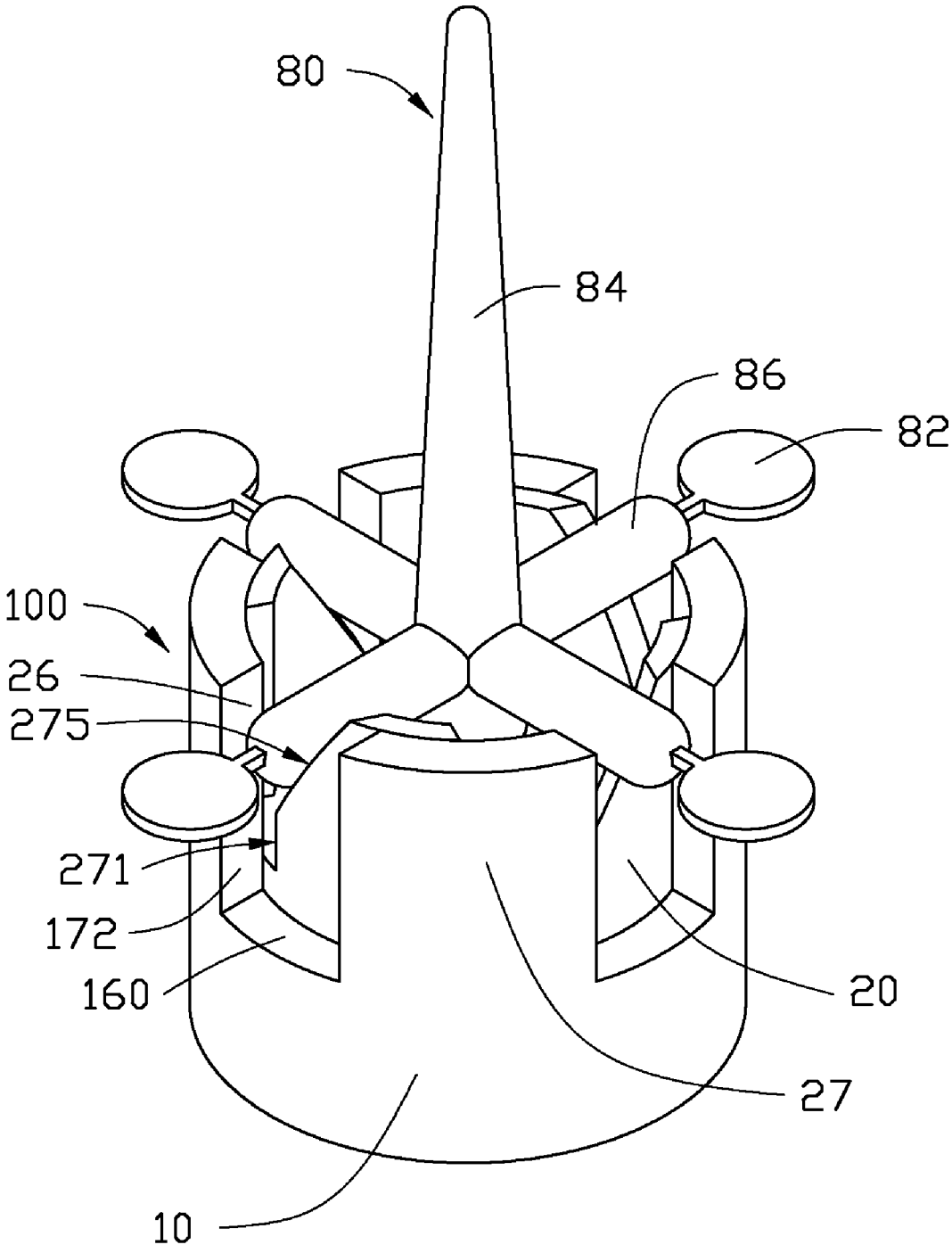
FIG. 4 is an isometric view of the clamping device of FIG. 2, together with a lens preform.

Referring also to FIG. 4, the clamping device 100 can be used to clamp a lens preform 80. As shown in FIG. 2 and FIG. 3, in this embodiment, before the lens preform 80 is clamped by the clamping device 100, the second barrel 20 is located in a first position of the first receiving space 10A. The two springs 30 each have a free length and are not under compression. That is, the two springs 30 is in a relaxed state. When the two springs 30 operate in the relaxed state, the second clamping portions 27 are close to the respective first clamping portions 17. The third side surface 271 and a portion of the fifth side surface 275 are exposed at the first slot 16. The fourth side surface 272 adjoins the internal peripheral surface 173 of the first clamping portion 17.

As shown in FIG. 4, in this embodiment, the lens preform 80 includes four lenses 82, a sprue 84, and four runners 86. The four runners 86 are respectively connected to the sprue 84, and surround the sprue 84. The four lenses 82 are connected to the four respective runners 86. In operation, the four runners 86 are arranged in the four respective second slots 26 with the sprue 84 facing away from the bottom surface 160 of the first barrel 10. Each runner 86 abuts against the fifth side surface 275 of the second clamping portion 27, and the second side surface 172 of the neighboring second clamping portion 27.

Figure 5:
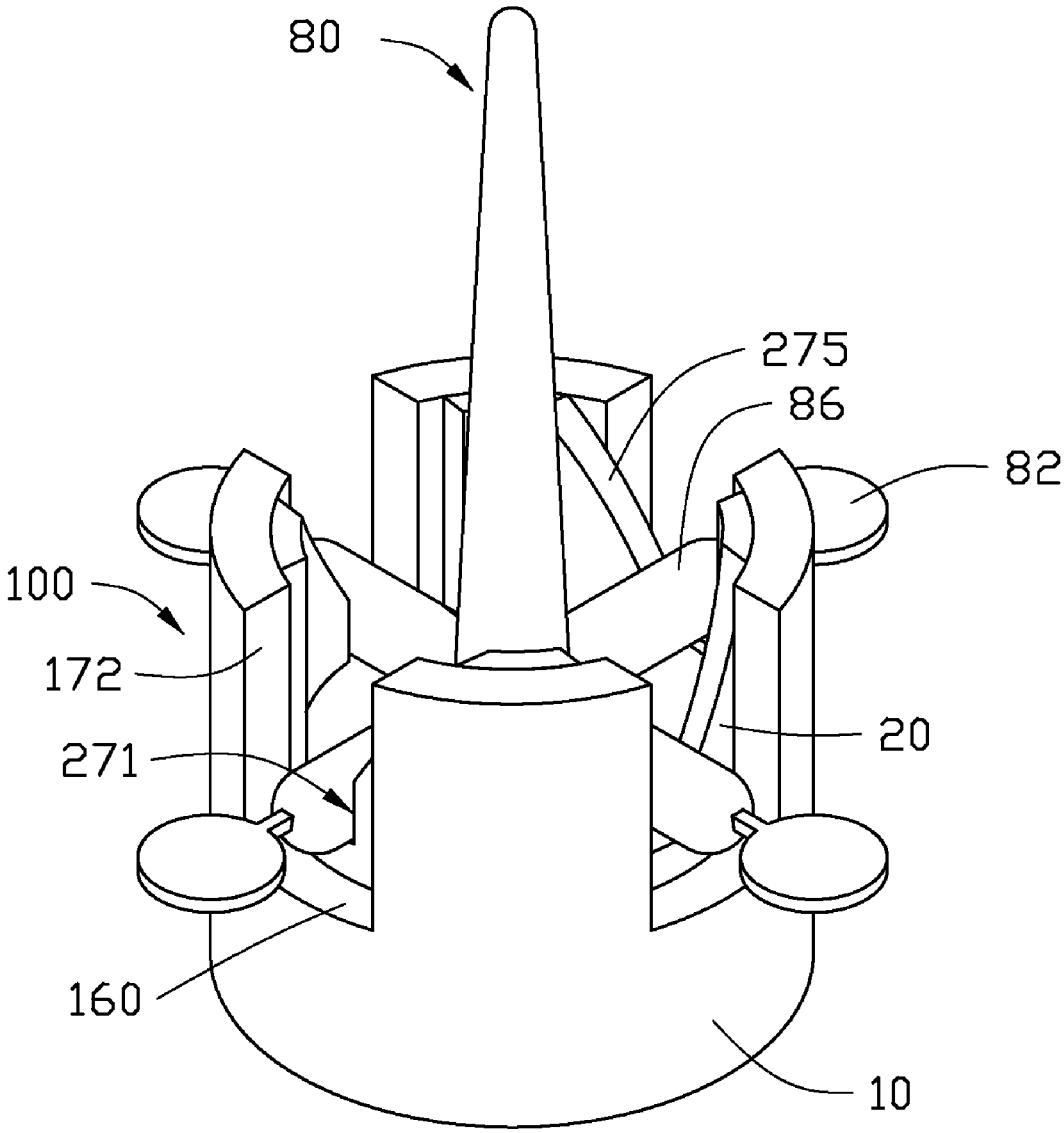
FIG. 5 is an isometric view of the clamping device of FIG. 4 showing the lens preform is clamped.

Referring to FIG. 5, when the lens preform 80 is pressed toward the bottom surface 160, the runner forming portion 86 presses the second barrel 20 on the fifth side surface 275 and the second side surface 172, thus driving the second barrel 20 to rotate relative the first barrel 10. Accordingly, the engaging portion 28 in the hole 18 rotates relative to the two blocks 18 of the first barrel 10. The second clamping portions 27 are further from the respective first clamping portions 17. A distance of the third side surface 271 and the second side surface 172 increases as the runner forming portions 86 moves toward the bottom surface 160. When a distance between the third side surface 271 and the second side surface 172 is the same as a diameter of the runner 86, the runner 86 slides from the fifth side surface 275 to the third side surface 271, and is located between the second side surface 172 and the third side surface 271. Thus, the second barrel 20 is located in a second position of the first receiving space 10A. The two springs 30 are loaded, for example compressed by the engaging portion 28 and the blocks 18. The two springs 30 each apply a torsional force on the first barrel 10 and the second barrel 20 to force the first clamping portions 17 to move toward the respective second clamping portions 27. Thus the lens preform 80 can be clamped firmly by the first clamping portions 17 and the respective second clamping portions 27.

When the lens preform 80 is clamped firmly by the clamping device 100, the lenses 82 can be cut from the runners 86 without vibration of the lens preform 80.

Figure 6:
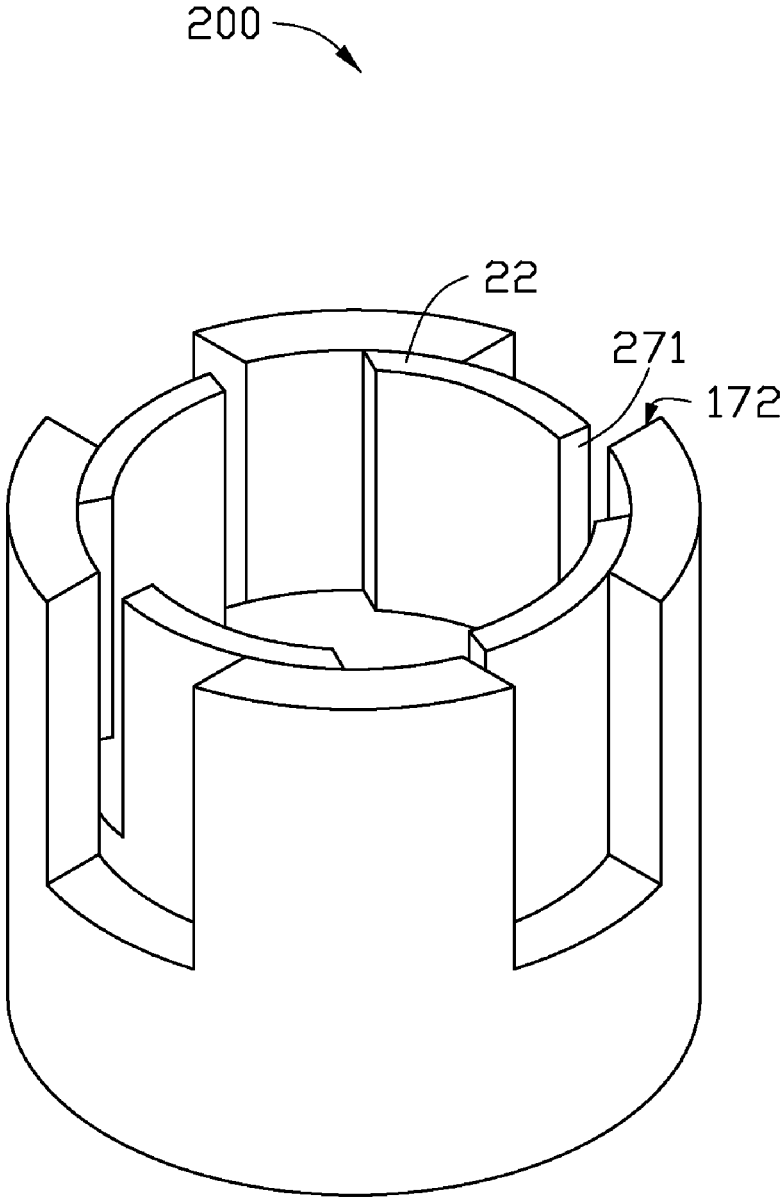
FIG. 6 is an assembled view of a clamping device in accordance with a second embodiment.

In this embodiment, the second clamping portion 27 has a fifth side surface 275 which is inclined to the second bottom surface 260. The fifth side surface 275 is configured for conveniently pressing the runner 86 between the second side surface 172 and the third side surface 271. Referring to FIG. 6, in alternative embodiments, for example, in a second embodiment of a clamping device 200, the third side surface 271 may extend all the way to adjoin the first top surface 22. The clamping device 200 can also be used to firmly clamp the lens preform 80 (refer back to FIGS. 4 and 5) by pressing the runner 86 between the second side surface 172 and the third side surface 271.

Figure 7:
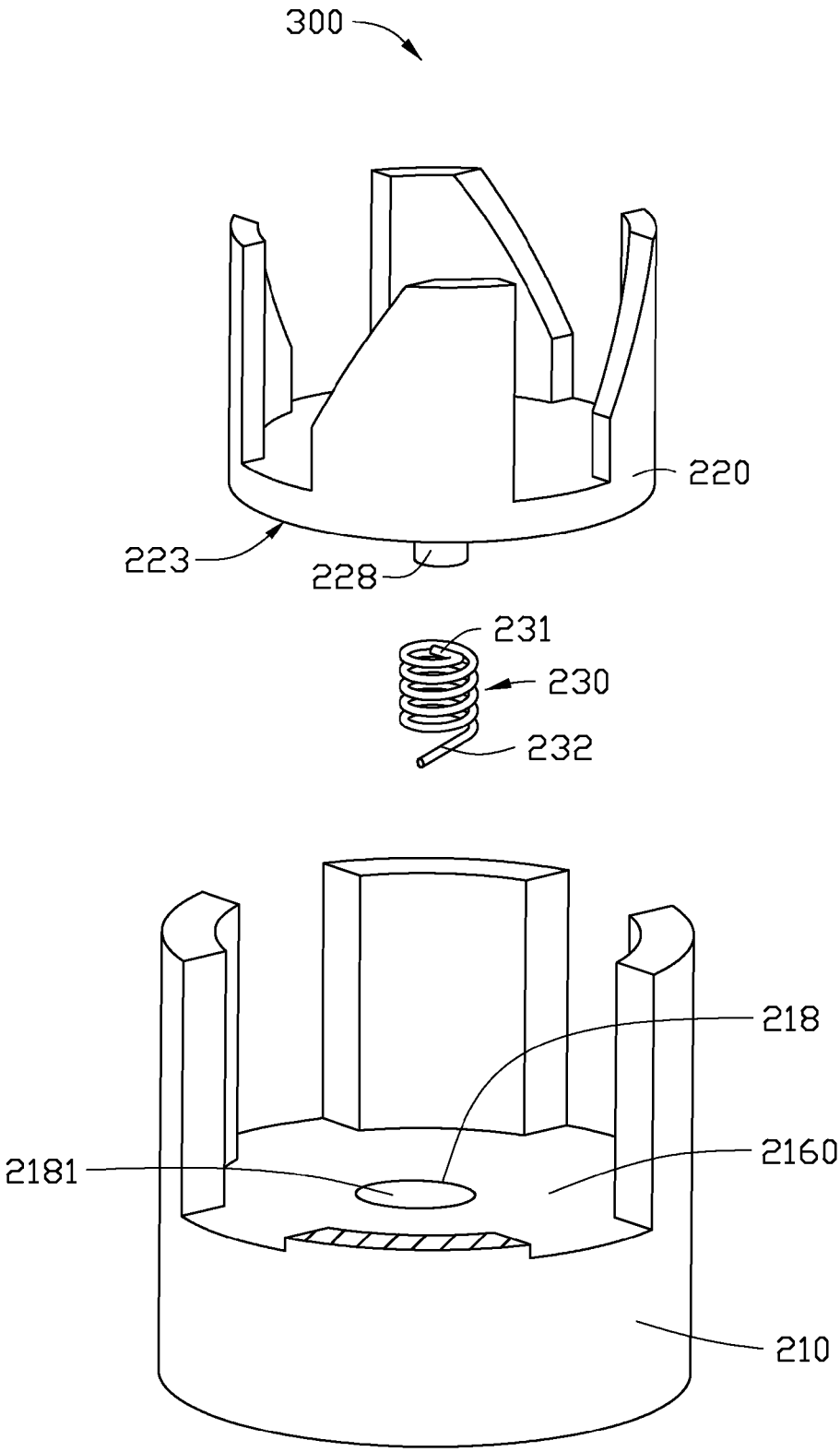
FIG. 7 is a disassembled view of a clamping device in accordance with a third embodiment.

FIG. 7 illustrates a clamping device 300 in accordance with a third embodiment. The clamping device 300 is similar to the clamping device 100 of the first embodiment in principle, and includes a first barrel 210, a second barrel 220, and a spring 230. However, for the clamping device 300, a hole 218 defined in a bottom surface 2160 of the first barrel 210 is cylindrically shaped without the blocks protruding from a inner sidewall 2181 thereof. An engaging portion 228 protruding from a second bottom surface 223 of the second barrel 210 and the engaging portion 228 is cylindrically shaped. In this embodiment, the spring 230 is a torsional spring with a first end 231 and a second end 232 at two opposite sides thereof. In use, the spring 230 can be arranged around the engaging portion 228 with the first end 231 fixed thereto. The second end 232 can be fixed to the inner sidewall 2181 of the first barrel 210. In operation, the spring 230 applies a torsional force on a lens preform 80 (refer back to FIG. 4 and FIG. 5) when the second barrel 220 rotates relative to the first barrel 210, thus the lens preform 80 also can be clamped firmly by the clamping device 300.

Figure 8:
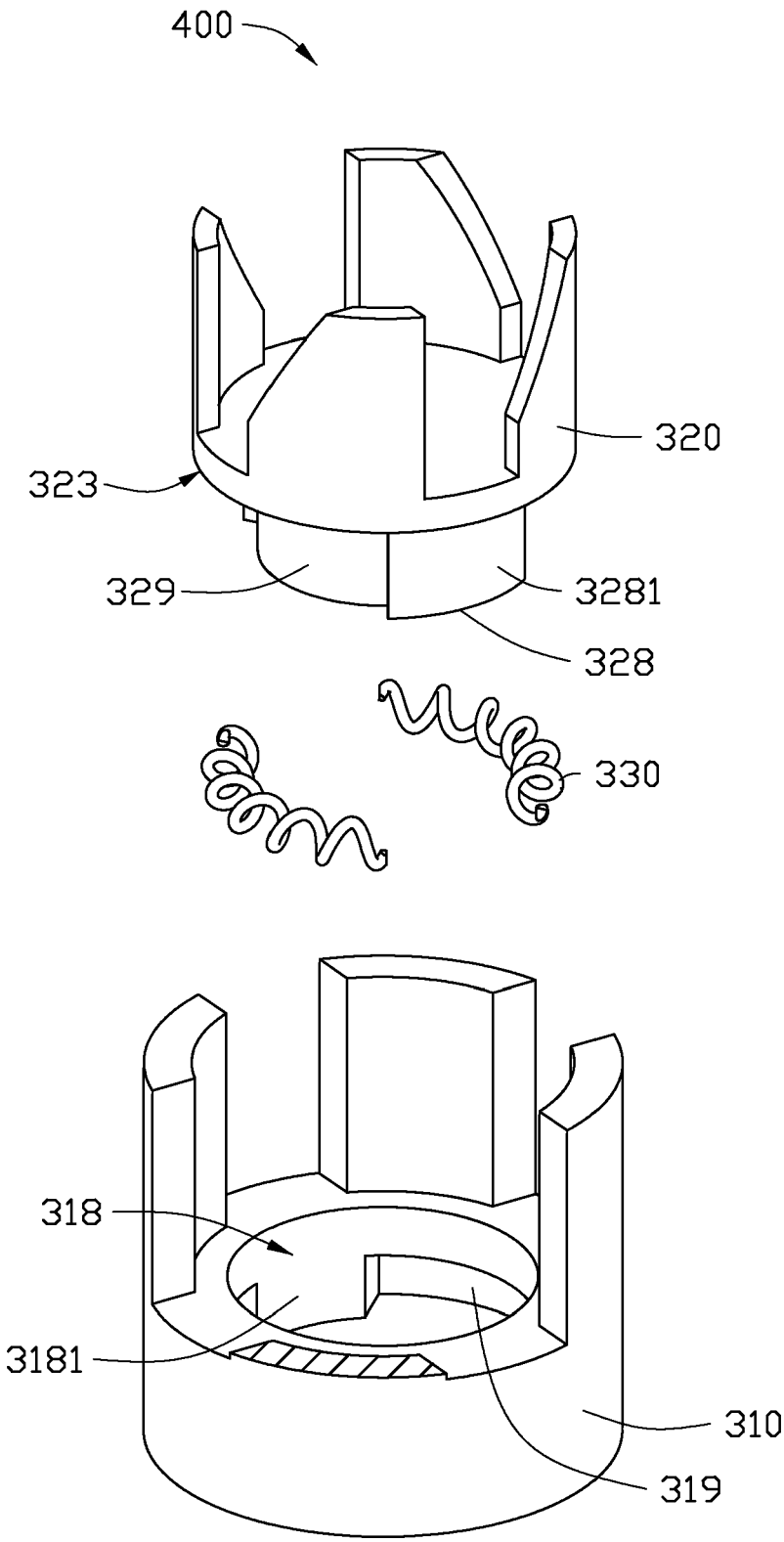
FIG. 8 is a disassembled view of a clamping device in accordance with a fourth embodiment, the clamping device including a first barrel, a second barrel, and two springs.

FIG. 8 shows a clamping device 400 in accordance with a fourth embodiment. The clamping device 400 is similar to the clamping device 300 of the third embodiment in principle, and includes a first barrel 310, a second barrel 320, and two springs 330. However, for the clamping device 400, has two first recesses 319 and are defined in an inner sidewall 3181 of the first barrel 310 in the hole 318. In this embodiment, an engaging portion 328 also is in the form of a cylinder, and includes an outer sidewall 3281 adjoining a second bottom surface 323 of the second barrel 320. The engaging portion 328 has two second recesses 329 defined in the outer sidewall 3281 thereof.

Figure 9:
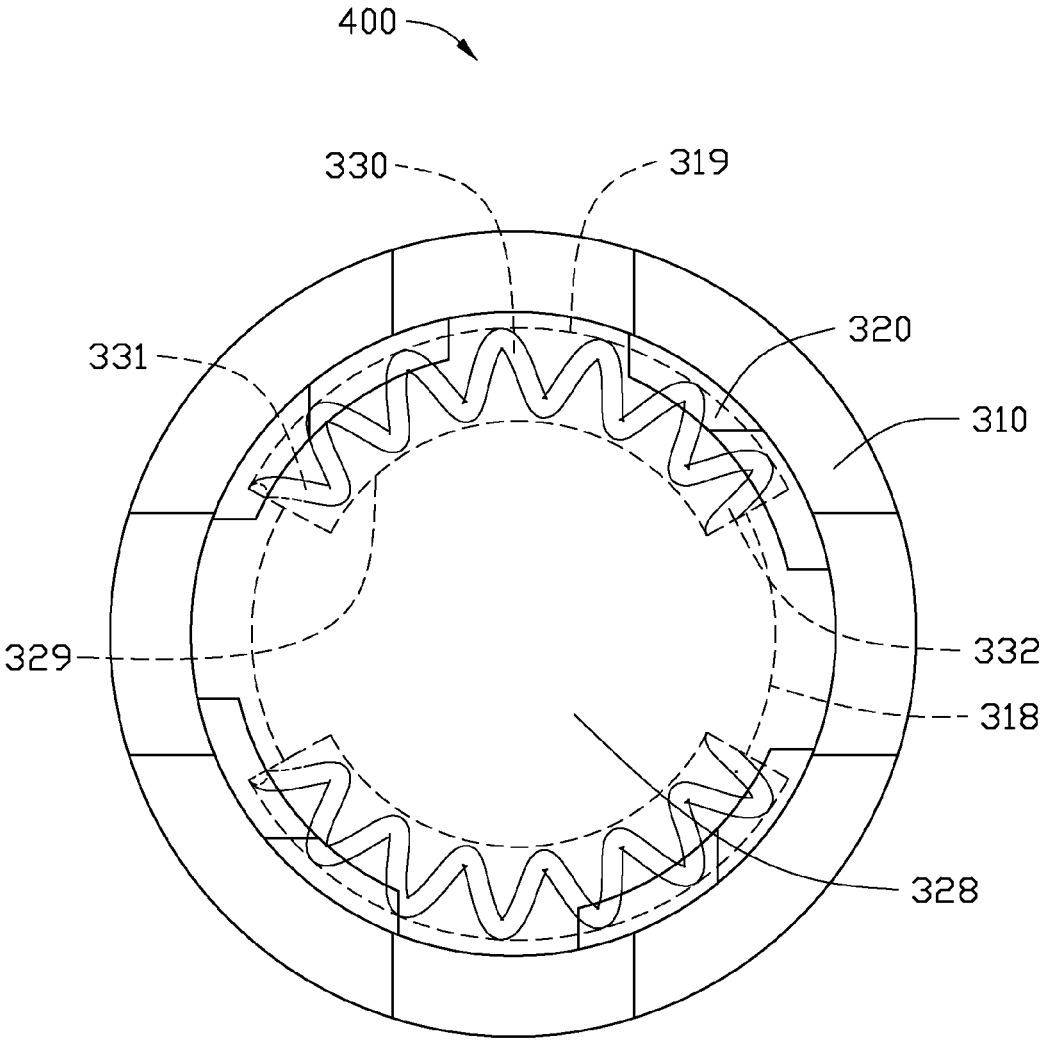
FIG. 9 is a top plan and disassembled view of the clamping device of FIG. 8, showing the first barrel and the second barrel cooperatively receiving the springs.
Figure 10:
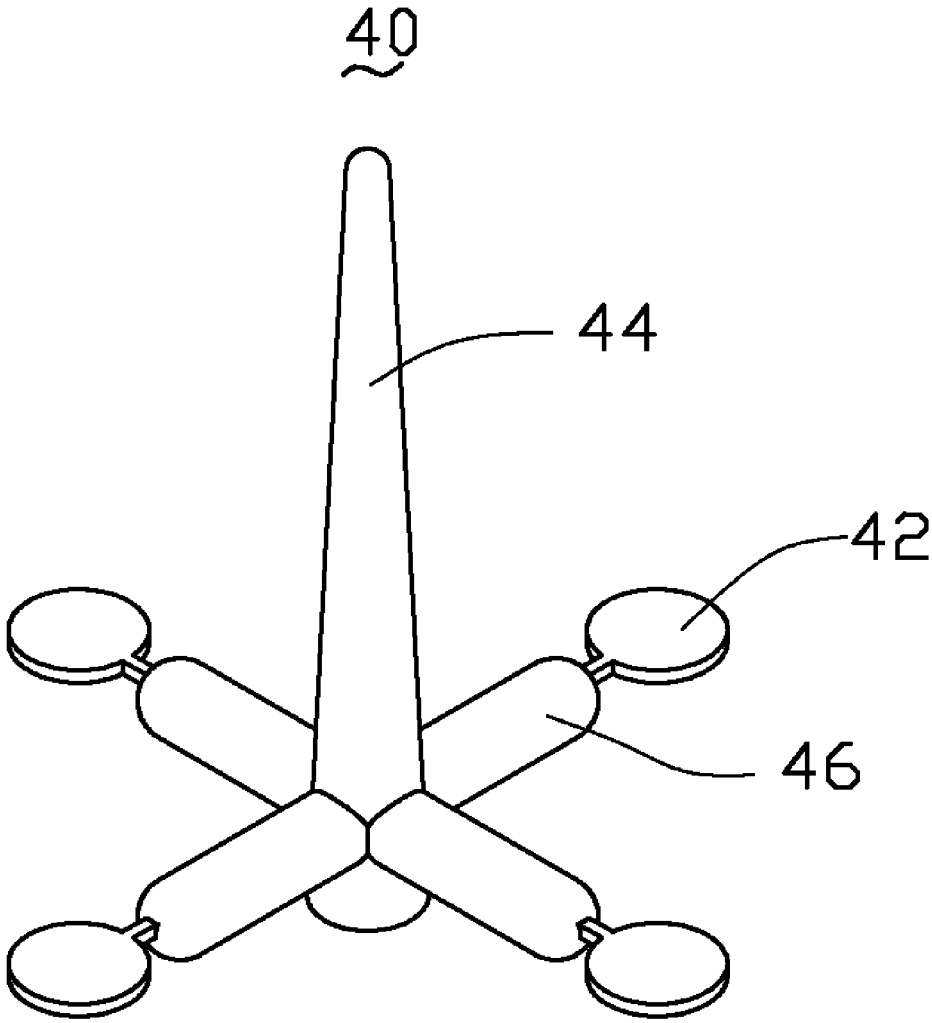
FIG. 10 (RELATED ART)
FIG. 10 is an isometric view of a typical lens preform.
Figure 11:
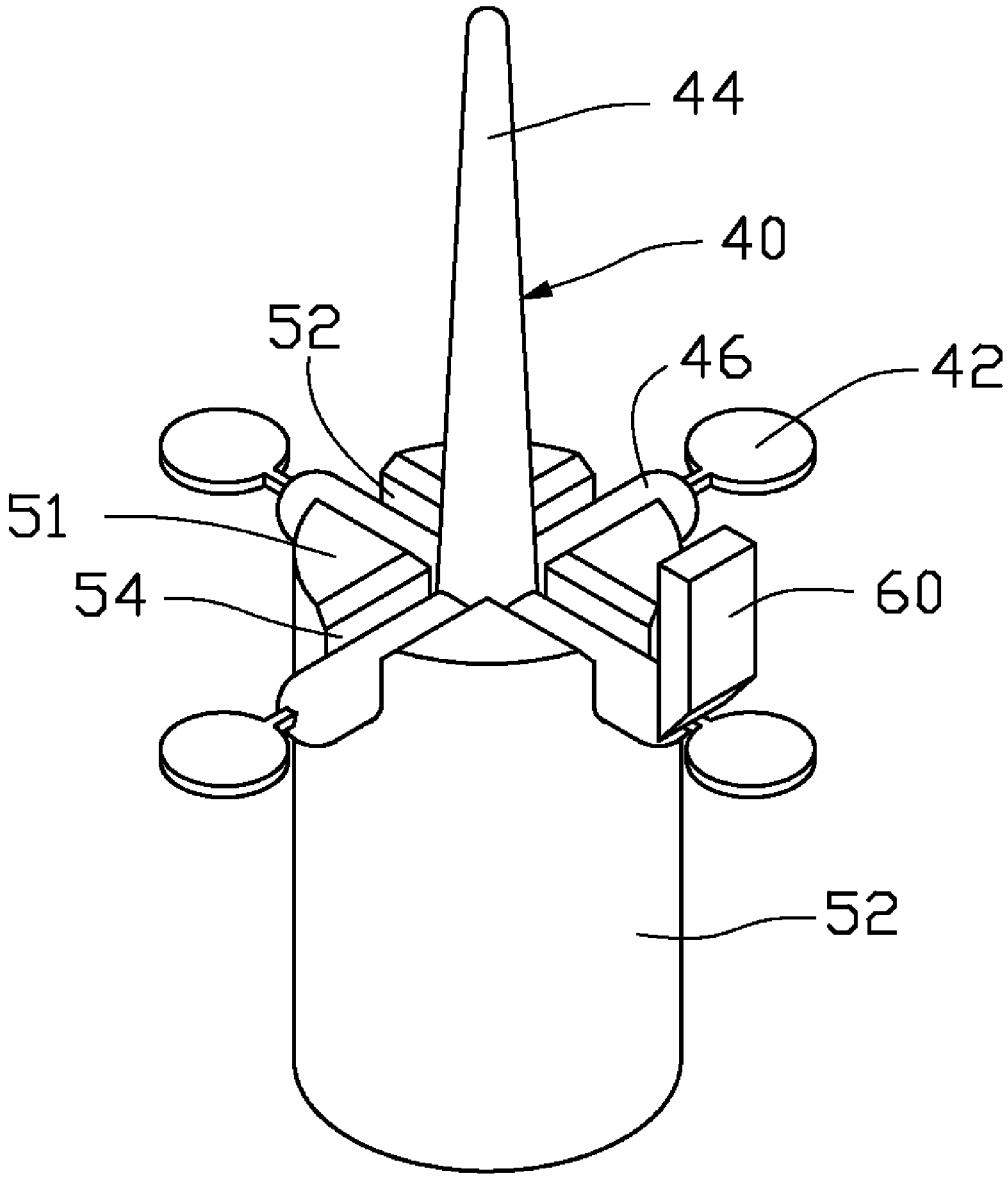
FIG. 11 (RELATED ART)
FIG. 11 is an isometric view of a typical clamping device with the lens preform of FIG. 10.

Referring also to FIG. 9, the two springs 330 each are coil springs having a first end 331 and a second end 332. A diameter of the hole 318 is the same as that of the engaging portion 328. In use, the engaging portion 328 is fittingly received in the hole 318 with the outer sidewall 3281 engaging with the inner sidewall 3181. The two first recesses 319 and the two second recesses 329 cooperatively form two accommodating spaces (not labeled) for accommodating the two springs 330. In this embodiment, the first ends 331 of the springs 330 are fixed to the first barrel 310 in the first recess 319 thereof. The second ends 332 of the springs 330 are fixed to the second barrel 320 in the second recess 329 thereof. In operation, the two springs 330 each apply a torsional force on a lens preform 80 (refer back to FIG. 4 and FIG. 5) when the second barrel 320 rotates relative to the first barrel 310, the lens preform 80 can be clamped firmly by the clamping device 400.

It is understood that the above-described embodiments are intended to illustrate rather than limit the disclosure. Variations may be made to the embodiments without departing from the spirit of the disclosure. Accordingly, it is appropriate that the appended claims be construed broadly and in a manner consistent with the scope of the disclosure.

What is claimed is:

1. A clamping device comprising:

at least one elastic element comprising a first end and a second end;

a first barrel attached to the first end of the at least one elastic element and comprising a plurality of first clamping portions, a plurality of first slots, and a first receiving space, the first clamping portions and the first slots being alternately arranged around the first receiving space; and a second barrel attached to the second end of the at least one elastic element and received in the first receiving space, the second barrel comprising a plurality of second clamping portions corresponding to the first clamping portions, a plurality of second slots, and a second receiving space, the second clamping portions and the second slots being alternately arranged around the second receiving space, the second barrel being rotatable relative to the first barrel in the first receiving space between a first position where the at least one elastic element is in a relaxed state and the second clamping portions are close to the corresponding first clamping portions, and a second position where the second clamping portions are further from the respective first clamping portions and the at least one elastic element applies a torsional force on the first barrel and the second barrel to force the first clamping portions to move toward the corresponding second clamping portions.

2. The clamping device of claim 1, wherein the second barrel is generally cylindrical, the first receiving space is generally cylindrical with a central axis, and a diameter of the second barrel is substantially equal to a diameter of the first receiving space.

3. The clamping device of claim 2, wherein the plurality of first clamping portions comprise four first clamping portions evenly spaced from each other around the first receiving space, and the plurality of second clamping portions comprise four second clamping portions evenly spaced from each other around the central axis of the first receiving space.

4. The clamping device of claim 2, wherein the first barrel has a hole defined in a bottom surface thereof, and the at least one elastic element is received in the hole.

5. The clamping device of claim 4, wherein each of the first clamping portions comprises a first side surface and a second side surface at two opposite sides thereof, the first side surface and the second side surface of each first clamping portion are exposed at the corresponding first slots and perpendicular to the bottom surface, each of the second clamping portions comprises a third side surface and a fourth side surface at two opposite sides thereof, and the third side surface and the fourth side surface of each second clamping portion are exposed at the corresponding second slots and perpendicular to the bottom surface.

6. The clamping device of claim 5, wherein each second clamping portion includes a first end adjacent to the bottom surface and a second end distal from the bottom surface, the second clamping portion has a cutout defined in the third side surface of the second end, and the second end tapers in a direction away from the bottom surface.

7. The clamping device of claim 4, wherein the second barrel further comprises an engaging portion received in the hole, and the engaging portion engages with an inner sidewall of the hole.

8. The clamping device of claim 7, wherein the first barrel further comprises two blocks extending from the inner sidewall at two opposite sides of the central axis, and a gap defined between the two blocks, the engaging portion extends through the gap, the at least one elastic element comprises two coil springs located at two opposite sides of the engaging portion, the two first ends of the two coil springs are attached to the respective blocks, and the two second ends of the two coil springs are attached to opposite sides of the engaging portion.

9. The clamping device of claim 7, wherein the engaging portion of the second barrel is in the form of a cylinder coaxially aligned with the central axis of the first receiving space, and the at least one elastic element comprises a torsional spring arranged around the engaging portion.

10. The clamping device of claim 7, wherein the at least one elastic element comprises a coil spring, the engaging portion of the second barrel is in the form of a cylinder coaxially aligned with the central axis of the first receiving space, and the engaging portion comprises an outer sidewall engaging with the inner sidewall of the hole, the first barrel has a first recess defined in the inner sidewall, the second barrel has a second recess defined in the outer sidewall, and the first recess and the second recess are configured for cooperating to receive the at least one elastic element.

11. A clamping device comprising:

at least one elastic element comprising a first end and a second end;

a first barrel attached to the first end of the at least one elastic element and comprising a bottom surface, a plurality of first clamping portions, a hole defined in the bottom surface, a plurality of first slots, and a first receiving space comprising the hole, the first clamping portions and the first slots being alternately arranged around the first receiving space; and a second barrel attached to the second end of the at least one elastic element and received in the first receiving space, the second barrel comprising a plurality of second clamping portions, a plurality of second slots, a second receiving space, and an engaging portion, the second clamping portions and the second slots being alternately arranged around the second receiving space;

the hole of the first barrel configured for receiving the at least one elastic element and the engaging portion of the second barrel, and the second barrel being rotatable relative to the first barrel in the first receiving space between a first position where the at least one elastic element is in a relaxed state and the second clamping portions are close to the respective first clamping portions, and a second position where the second clamping portions are further from the corresponding first clamping portions and the at least one elastic element applies a torsional force on the first barrel and the second barrel to force the first clamping portions to move toward the corresponding second clamping portions.

12. The clamping device of claim 11, wherein the second barrel is generally cylindrical, the first receiving space is generally cylindrical with a central axis, and a diameter of the second barrel is substantially equal to a diameter of the first receiving space.

13. The clamping device of claim 12, wherein the plurality of first clamping portions comprise four first clamping portions evenly spaced from each other around the first receiving space, and the plurality of second clamping portions comprise four second clamping portions evenly spaced from each other around the central axis of the first receiving space.

14. The clamping device of claim 11, wherein each of the first clamping portions comprises a first side surface and a second side surface at two opposite sides thereof, the first side surface and the second side surface of each first clamping portion are exposed at the corresponding first slots and perpendicular to the bottom surface, each of the second clamping portions comprises a third side surface and a fourth side surface at two opposite sides thereof, and the third side surface and the fourth side surface of each second clamping portion are exposed at the corresponding second slots and perpendicular to the bottom surface.

15. The clamping device of claim 11, wherein each second clamping portion includes a first end adjacent to the bottom surface and a second end distal from the bottom surface, the second clamping portion has a cutout defined in the third side surface of the second end, and the second end tapers in a direction away from the bottom surface.

16. The clamping device of claim 11, wherein the engaging portion engages with an inner sidewall of the hole.

17. The clamping device of claim 16, wherein the first barrel further comprises two blocks extending from the inner sidewall at two opposite sides of the central axis, and a gap defined between the two blocks, the engaging portion extends through the gap, the at least one elastic element comprises two coil springs located at two opposite sides of the engaging portion, the two first ends of the two coil springs are attached to the two respective blocks, and the two second ends of the two coil springs are attached to opposite sides of the engaging portion.

18. The clamping device of claim 16, wherein the engaging portion of the second barrel is in the form of a cylinder coaxially aligned with the central axis of the first receiving space, and the at least one elastic element comprises a torsional spring arranged around the engaging portion.

19. The clamping device of claim 16, wherein the at least one elastic element comprises a coil spring, the engaging portion of the second barrel is in the form of a cylinder coaxially aligned with the central axis of the first receiving space, and the engaging portion comprises an outer sidewall engaging with the inner sidewall of the hole, the first barrel has a first recess defined in the inner sidewall, the second barrel has a second recess defined in the outer sidewall, and the first recess and the second recess are configured for cooperating to receive the at least one elastic element.

20. A clamping device comprising:

a first barrel comprising a plurality of spaced first clamping portions, the first clamping portions arranged along a first imaginary circle;

a second barrel coaxially aligned with and received in the first barrel, the second barrel comprising a plurality of spaced second clamping portions arranged along a second imaginary circle, a diameter of the second imaginary circle being less than a diameter of the first imaginary circle; and a torsional spring member coupled between the first barrel and the second barrel, the second barrel being rotatable relative to the first barrel in the first receiving space between a first position where the torsional spring member is in a relaxed state and the second clamping portions are close to the corresponding first clamping portions, and a second position where the second clamping portions are further from the respective first clamping portions and the torsional spring member applies a torsional returning force on the first barrel and the second barrel to force the first clamping portions to move toward the corresponding second clamping portions.

* * * * *